United States Patent [19]

Albertson et al.

[11] Patent Number: 4,932,371

[45] Date of Patent: Jun. 12, 1990

[54] EMISSION CONTROL SYSTEM FOR A CRANKCASE SCAVENGED TWO-STROKE ENGINE OPERATING NEAR IDLE

[75] Inventors: William C. Albertson, Sterling Heights; Donald M. Fenton, Drayton Plains; Paul E. Reinke, Rochester; Steven D. Stiles, Clarkston, all of Mich.

[73] Assignee: General Motors Corporation, Detroit, Mich.

[21] Appl. No.: 393,189

[22] Filed: Aug. 14, 1989

[51] Int. Cl.[5] ..... F02B 33/04

[52] U.S. Cl. ..... 123/73 SP; 123/65 R; 123/403; 123/339

[58] Field of Search ..... 123/52 M, 65 R, 73 C, 123/73 SP, 400, 403, 513, 339, 436, 419

[56] References Cited

U.S. PATENT DOCUMENTS

| | | | |
|---|---|---|---|
| 2,332,916 | 10/1943 | Johnson | 123/73 SP |
| 4,213,431 | 7/1980 | Onishi | 123/73 SP |
| 4,768,494 | 9/1988 | Hale | 123/198 F |
| 4,825,821 | 5/1989 | Baltz et al. | 123/73 SP |
| 4,840,148 | 6/1989 | Staerzl | 123/73 A |
| 4,850,318 | 7/1989 | Torigai et al. | 123/352 |

FOREIGN PATENT DOCUMENTS

| | | | |
|---|---|---|---|
| 2738391 | 3/1978 | Fed. Rep. of Germany | 123/73 A |
| 594497 | 1/1959 | Italy | 123/73 A |
| 0158328 | 9/1984 | Japan | 123/73 A |
| 2208893 | 4/1989 | United Kingdom | 123/472 |

*Primary Examiner*—David A. Okonsky
*Attorney, Agent, or Firm*—Howard N. Conkey

[57] ABSTRACT

An engine control system is disclosed for reducing the hydrocarbon content in exhaust gas from a crankcase scavenged, two-stroke engine in the operating range near idle, with light operator induced engine loading. As operator demand for engine output power is increased, the control system increases the fuel per cylinder delivered to the engine, while restricting the supplied mass of air per cylinder to a value less than or equal to that flowing at unloaded engine idle.

6 Claims, 3 Drawing Sheets

EMISSION CONTROL SYSTEM FOR A CRANKCASE SCAVENGED TWO-STROKE ENGINE OPERATING NEAR IDLE

BACKGROUND OF THE INVENTION

This invention relates to engine control for a crankcase scavenged, two-stroke engine, and more particularly to a control system for reducing the exhaust gas hydrocarbons emitted from such an engine at and slightly above idle speed and low power requirements, by controlling the quantity of intake air and fuel delivered to the engine.

In conventional four-stroke engines, as operator demand for engine power is increased from idle, the standard practice is to increase the amount of air per cylinder supplied to the engine. This produces an increase in the delivered fuel per cylinder, maintaining the appropriate air-fuel ratio to achieve the desired engine performance and emission objectives.

The structure and operation of crankcase scavenged, two-stroke engines differ in many respects from that of conventional four-stroke engines. One of the major differences concerns the manner in which fresh air is inducted, and burned fuel is exhausted by the engines. Conventional four-stroke engines have intake and exhaust valves within the cylinders to accomplish these tasks. Crankcase scavenged, two-stroke engines, on the other hand, do not employ intake and exhaust valves. Instead, inlet and exhaust ports open directly into the walls of the engine cylinders. The inlet and exhaust ports are covered and uncovered by movement of the piston within the cylinder. As combustion is initiated, the piston moves in its downstroke within a cylinder, uncovering the exhaust port to release burned fuel, and then uncovering the inlet port to enable the entry of a fresh charge of air, which assists in driving out the burned fuel.

One of the major problems associated with crankcase scavenged, two-stroke engines has been the high level of hydrocarbons present in the engine exhaust gas. At speeds near engine idle, with light operator induced loading, the level of exhaust gas hydrocarbons is highly dependent upon the amount of air per cylinder delivered to the engine. This relationship is thought to result from the absence of valves in the two-stroke engine, and the near simultaneous opening of both inlet and exhaust ports in a cylinder wall for brief periods during the engine operating cycle. Presumably, an excessive amount of air flowing through the inlet port, drives fuel, which is not fully combusted, out the open exhaust port, thereby increasing the hydrocarbon content in the exhaust gas.

If the conventional practice is followed in controlling the near idle operation of a crankcase scavenged, two-stroke engine, by increasing the mass air per cylinder flowing to the engine, upon operator demand for output power, the level of hydrocarbons in the engine exhaust will be unreasonably high. Consequently, a need exists for an alternative engine control scheme for crankcase scavenged, two stroke engines operating at speeds near idle, with light operator induced loading.

SUMMARY OF THE INVENTION

According to one aspect of the invention, as operator demand for engine output power increases, over a defined range of engine operation near idle, the fuel per cylinder delivered to the engine is increased; however, the air per cylinder delivered to the engine is restricted, to be less than or equal to that delivered at unloaded engine idle. This results in a reduced level of hydrocarbons in the exhaust gas for the crankcase scavenged two-stroke engine, even though this practice is contrary to that used with conventional four-stroke engines.

In another aspect of the invention, at a given engine speed, the fuel per cylinder delivered to the engine depends upon both operator demand for engine output power and the mass of air per cylinder delivered to the engine. Within the defined range of engine operation near idle speed, where air flow is restricted, the fuel rate is primarily determined by operator demand for engine output. As the demand for output power increases from unloaded idle, a transition point is reached where the influence of operator demand in determining the fuel rate is diminished, while the influence of the delivered mass of air per cylinder is enhanced. Consequently, this blending procedure assures continuity in fuel delivery and smooth engine performance, as increased loading moves engine operation into a region where the supplied fuel per cylinder depends primarily upon the delivered mass air per cylinder.

According to one embodiment of the invention, the mass of air per cylinder delivered to the the engine is restricted to a constant value, equal to that delivered at unloaded engine idle, over the defined range of engine operation near idle. This restriction results in a lower level of hydrocarbons in the engine exhaust gas, when compared with the standard practice of increasing the mass air per cylinder with increased demand for engine output power. Preferably, this is accomplished by providing a mechanism for lost motion in the linkage between an accelerator pedal and a throttle valve in an engine intake manifold. Thus, initial movement of the accelerator pedal does not open the throttle valve, and mass air flow per cylinder is maintained at a constant level, until the range of lost motion in the linkage is exceeded. This results in a simple and inexpensive method for reducing hydrocarbon exhaust gas emissions from the two-stroke engine.

In another embodiment of the invention, exhaust gas hydrocarbons are further reduced, by decreasing the mass of air per cylinder delivered to the engine, from that delivered at unloaded engine idle, according to a predetermined schedule, as the demand for engine output is increased. Preferably, this is accomplished by utilizing the lost motion throttle linkage, and in addition, connecting a bypass line to the intake manifold, on opposite sides of the throttle valve. A solenoid controlled bypass valve is placed within the bypass passage for controlling the flow of air around the throttle valve. By closing the bypass valve, which is partially open at unloaded engine idle, the delivered mass of air per cylinder can be decreased according to a predetermined schedule, over the wasted motion interval associated with the throttle linkage. This decrease in the delivered mass of air per cylinder results in a further reduction in exhaust gas hydrocarbons, when compared to maintaining mass air per cylinder constant using the lost motion throttle linkage alone. Further, the extra degree of control over air flow, provided by the air bypass valve, has the additional advantage that a tightly sealed throttle valve is not required for the intake manifold. As a result, the throttle body and plate forming the valve within the intake manifold can have larger tolerances, making the assemblage less expensive to manufacture.

These and other aspects and advantages of the invention may be best understood by reference to the following detailed description of a preferred embodiment when considered in conjunction with the accompanying drawing.

DESCRIPTION OF THE PREFERRED EMBODIMENT

Figure 1:
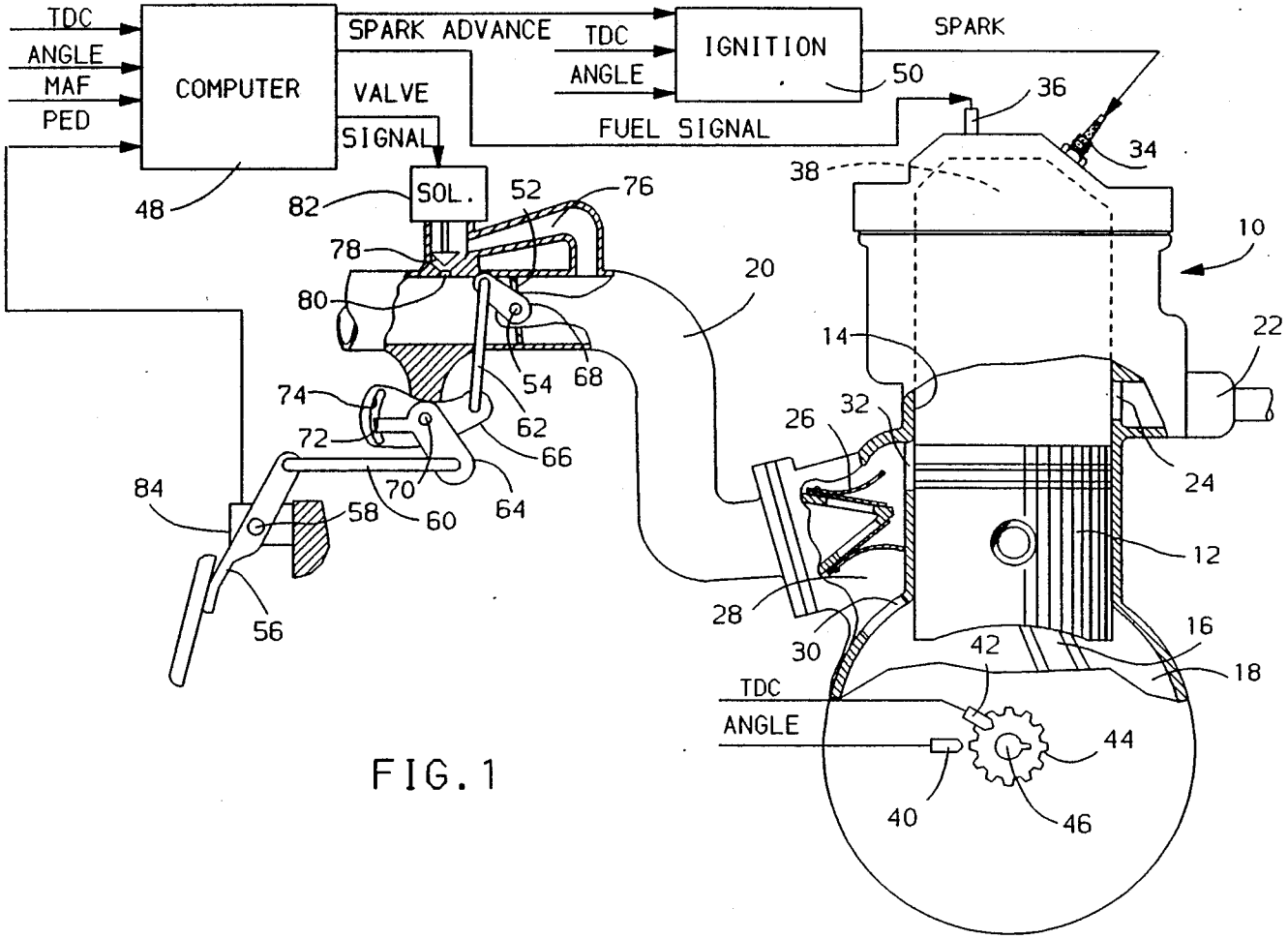
FIG. 1 is a schematic diagram of a crankcase scavenged two-stroke engine and a control system, which includes a system for reducing hydrocarbon exhaust gas emissions according to the principles of this invention.

Referring to FIG. 1, there is shown schematically a crankcase scavenged two-stroke engine, generally designated as 10, with a portion of the engine exterior cut away, exposing cylinder 14. Piston 12 resides within the wall of cylinder 14, with rod 16 connecting piston 12 to a rotatable crankshaft, not shown, but disposed within crankcase chamber 18. Connected to engine 10 is an air intake manifold 20 and an exhaust manifold 22. Cylinder 14 communicates with exhaust manifold 22 through exhaust port 24 in the wall of cylinder 14. Intake manifold 20 communicates with cylinder 14 and crankcase chamber 18 through a reed valve checking mechanism 26, which opens into a common air transfer passage 28 linking crankcase port 30 with inlet port 32 in the wall of cylinder 14. Cylinder 14 is provided with a spark plug 34 and an electric solenoid driven fuel injector 36 projecting into combustion chamber 38.

Standard electromagnetic sensors 40 and 42 provide pulsed signals indicative of engine rotational angle (ANGLE) and the top dead center (TDC) position for cylinder 14, by respectively sensing the movement of teeth on ring gear 44 and disk 46, which are attached to the end of the engine crankshaft.

Computer 48 is a conventional digital computer used by those skilled in the art of engine control, and includes the standard elements of a central processing unit, random access memory, read only memory, analog-to-digital converter, input/output circuitry, and clock circuitry. Using pulsed input signals ANGLE and TDC from electromagnetic sensors 40 and 42, computer 48 determines the angular position of the engine crankshaft for fuel and spark timing. The crankshaft rotation from top dead center in cylinder 14 may be obtained by counting the number of pulses occurring in ANGLE, after the TDC pulse, then multiplying the number of counted pulses by the angular spacing of the teeth on ring gear 44. Also, the engine speed in revolutions per minute (RPM) may be obtained by counting the number of TDC pulses which occur in a specified period of time, and then multiplying by the appropriate conversion constant.

The MAF input signal to computer 48 is indicative of the mass of air flowing into engine 10. From the MAF input, computer 44 determines the mass of air per cylinder delivered to engine 10, and computes the proper amount of fuel to be injected to maintain a predefined air-fuel ratio. The MAF signal can be derived from a conventional mass air-flow sensor mounted within intake manifold 20, or alternatively, by computer processing of a pressure signal produced by a pressure sensor placed within crankcase chamber 18. This later technique involves integration of the crankcase pressure over an interval of changing crankcase volume as disclosed in U.S. application Ser. No. 377,383, filed July 10, 1989 by S. D. Stiles et al, co-pending with the present application and assigned to the same assignee.

Using the above inputs, and signals from other conventional sensors which have not been shown in FIG. 1, computer 48 performs the required computations, and provides the output signals FUEL SIGNAL and SPARK ADVANCE. The FUEL SIGNAL consists of an output pulse having a width that determines the time during which fuel injector 36 is operative to inject fuel into cylinder 14. The SPARK ADVANCE output signal is related to spark timing and is an input for ignition system 50.

Ignition system 50 generates a high voltage SPARK signal, which is applied to spark plug 34 at the appropriate time, as determined by the SPARK ADVANCE signal supplied by computer 48 and the position of the engine crankshaft which can be derived from the TDC and ANGLE signals. Ignition system 50 may include a standard distributor or take any other appropriate form in the prior art.

The operation of engine 10 will now be briefly described based upon the cycle occurring in cylinder 14. During the upstroke, piston 12 moves from its lowest position in cylinder 14 toward top dead center. During the upward movement of piston 12, air inlet port 32 and exhaust port 24 are closed off from the combustion chamber 38, and thereafter, air is inducted into crankcase chamber 18 through reed valve 26. Air in combustion chamber 38, above piston 12, is mixed with fuel from injector 36 and compressed until spark plug 34 ignites the mixture near the top of the stroke. As combustion is initiated, piston 12 begins the downstroke, decreasing the volume of crankcase chamber 18 and the inducted air within it, due to closure of valve reed valve 26. Toward the end of the down stroke, piston 12 uncovers exhaust port 24 to release the combusted fuel, followed by uncovering of the inlet port 32, enabling compressed air within the crankcase chamber 18 to flow through the air transfer passage 28 into cylinder 14. The cycle begins anew when piston 12 reaches the lowest point in cylinder 14.

Conventionally, in a four-stroke engine, as operator demand for engine power is increased, the standard practice is to increase the amount of air per cylinder delivered to an engine. This in turn increases the the fuel per cylinder delivered the engine, to maintain the proper air-fuel ratio, and consequently increases engine output power. However, in the crankcase scavenged, two-stroke engine 10, at engine speeds near idle, the level of exhaust gas hydrocarbons is highly dependent upon the amount of air per cylinder delivered to the engine. This relationship is thought to result from the absence of valves in engine 10, and the near simultaneous opening of inlet port 32 and exhaust port 24 for brief periods during the engine operating cycle. Presumably, excessive air flowing through inlet port 32 drives fuel products, which are not fully combusted, out the open exhaust port 24, thereby increasing hydrocarbon emissions from engine 10.

Figure 2:
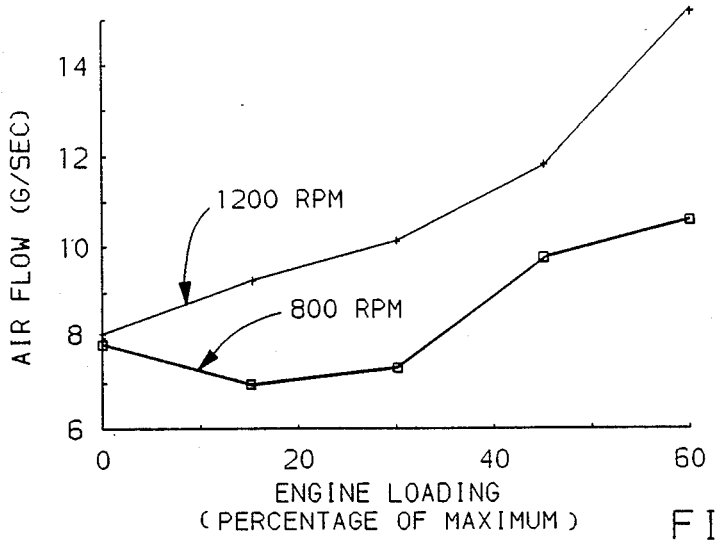
FIG. 2 is a graphical representation of a partial speed-load map for a crankcase scavenged two-stroke engine, illustrating the required engine air flow for minimum hydrocarbon emissions.

Referring now to FIG. 2, there is shown a graph of typical speed-load data for a crankcase scavenged, two-stroke engine. This data was obtained by standard engine dynamometer measurements known to those skilled in the art of engine control. The desired engine air flow, to produce minimum exhaust gas hydrocarbons, is given as a function of the percentage of maximum engine loading, for engine speeds of 800 and 1200 RPM. The axis representing percentage of maximum engine loading is also equivalent to the percentage of maximum engine output power demanded by the operator For an engine operating at 1200 RPM, the desired engine air flow monotonically increases as engine loading (or operator demand for engine output power) increases. In contrast, for an engine operating at the idle speed of 800 RPM, the engine air flow for minimum hydrocarbon emissions must be decreased from that flowing at unloaded idle, as operator demand for output power increases up to approximately 35 percent of the maximum loading. This same type of behavior occurs for engine speeds up to approximately 1000 RPM, as is evident by interpolating between the curves for 800 and 1200 RPM. Thus, if the standard practice is followed in controlling engine 10, at speeds near idle (800–1000 RPM), increasing air flow to engine 10, upon operator demand for output power will result in an unnecessarily high level of hydrocarbons in the exhaust gas. For this reason, alternative engine control is needed for a crankcase scavenged, two-stroke engine.

The present invention is directed toward controlling the amounts of fuel and air delivered to a crankcase scavenged, two-cycle engine to reduce hydrocarbon emissions, when the engine operation is near idle (800–1000 RPM), with light operator induced loading (up to approximately 35 percent of maximum load). This is accomplished by restricting the mass of air per cylinder delivered to the engine to less than or equal that delivered at unloaded engine idle, over the defined range of engine operation.

Referring again to FIG. 1, the preferred embodiment of the present invention will now be described. Throttle plate 52, rotates about a throttle shaft 54, within intake manifold 20, to form a throttle valve for controlling the amount of air per cylinder delivered to engine 10. Accelerator pedal 56 functions as an operator actuated control element, indicating the amount of engine output power demanded by the operator. Not shown is a spring or other resilient means associated with accelerator pedal 56 for returning it to an initial position, once operator actuation ceases. Increased counterclockwise movement of accelerator pedal 56 about pivot pin 58 indicates an increased demand for engine output power.

Connecting accelerator pedal 56 to throttle plate 52 is a linkage assembly consisting of levers 60 and 62, along with links 64, 66, and 68. Link 68, being rigidly attached to throttle shaft 54, provides a means for rotating throttle plate 52 within intake manifold 20. Links 64 and 66 have a common pivot pin 70, with tang 72 projecting from link 64, into a slot 74 formed in link 66. Lever 60 connects accelerator pedal 56 with link 64, while lever 62 connects link 66 with link 68, each lever end forming a pivotal connection with the element connected.

In operation, the throttle linkage assembly provides a means for operator control of the throttle valve formed by the throttle plate 52 in intake manifold 20. The initial position of accelerator pedal 56 corresponds to steady state condition of unloaded engine idle, with throttle plate 52 at its minimum idle setting for air flow through the throttle valve. As accelerator pedal 56 is moved from its initial position with increased operator demand for engine output, it rotates counterclockwise about pivot pin 58. This in turn pulls lever 60, causing link 64 to rotate clockwise about pivot pin 70. Link 64 rotates freely without affecting the movement of link 66, until tang 72 reaches the end of slot 74. Then tang 72 engages link 66 causing it to rotate in a clockwise direction about pivot pin 70, with any additional movement of the accelerator pedal 56. As link 66 rotates in a clockwise direction, lever 62 is pulled to rotate link 68 in a direction counterclockwise about the axis of throttle shaft 54. Since link 68 and throttle plate 52 are rigidly attached to shaft 54, counterclockwise movement of link 68 effectuates opening of throttle plate 52, enabling increased air flow to the engine 10.

Figure 3:
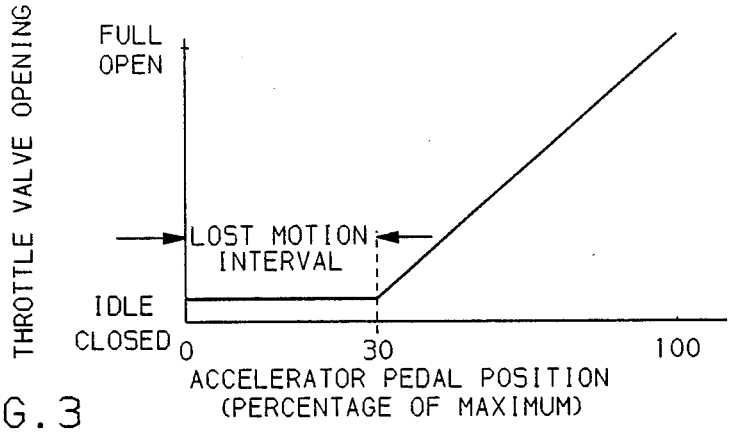
FIG. 3 is a graphical representation of throttle valve opening as a function of accelerator pedal position, illustrating the interval of lost motion associated with the throttle linkage.

The relationship between the position of accelerator pedal 56 and throttle valve opening is shown in FIG. 3.

The linkage assembly provides for an interval of lost motion with respect to initial movement of the accelerator pedal 56. Over this interval of lost motion, movement of the accelerator pedal 56 does not affect the opening of the throttle plate 52 and the air flow to the engine remains constant. As movement of the accelerator pedal 56 continues, the point is reached where tang 72 engages link 66, and throttle plate 52 is then opened. Slot 74 is preferably formed so that the accelerator pedal 56 can move approximately 30 percent of its full movement before tang 72 engages link 66, thereby effectuating opening of throttle valve.

In addition to the throttle linkage assembly, the preferred embodiment of the present invention requires a mechanism for further reducing air flow through intake manifold 20, during the linkage lost motion interval. Referring again to FIG. 1, intake manifold 20 is provided with an passage 76, which bypasses the throttle valve formed by throttle plate 52 in manifold 20. Within passage 76 is a bypass valve 78 for restricting air flow. The position of bypass valve 78 with respect to passage port 80 in the intake manifold 20, determines the amount of air bypassing the throttle valve. Computer 48 remotely controls the position of bypass valve 78 by sending the appropriate VALVE SIGNAL to an electric solenoid 82, which actuates the bypass valve 78 and is mounted on intake manifold 20. At unloaded engine idle, bypass valve 78 is positioned to be one-half open, with the idle setting of throttle plate 52 adjusted so that the total mass air flow through intake manifold 20 corresponds to that value which produces minimum hydrocarbon emissions (see FIG. 2). The combination of the bypass valve 78 and the wasted motion throttle linkage provides the means for reducing the delivered mass air per cylinder to conform to the predefined schedule for minimum hydrocarbon emissions at engine speeds near idle (800–1000 RPM), with light operator loading (up to approximately 35 percent of maximum load).

An additional computer input is provided by a potentiometer 84, which senses the position of the accelerator pedal 56 and supplies the representative signal PED to computer 48. This PED signal indicates the percentage of engine output power demanded by the operator, or equivalently, the percentage of operator induced engine loading. Based on the position of the accelerator pedal, as indicated by the PED signal, computer 48 adjusts the position of bypass valve 78 to reduce the mass of air per cylinder flowing to engine 10 in accordance with the schedule for minimum exhaust gas hydrocarbons as defined by data presented in FIG. 2. Computer 48 is informed that the end of the lost motion interval of the throttle linkage has been reached when the PED signal indicates that the accelerator pedal has moved 30 percent of its full range of movement. Further movement of the accelerator pedal in the direction of increased engine loading, results in opening of throttle plate 46 to increase the mass air flow to engine 10.

Figure 4:
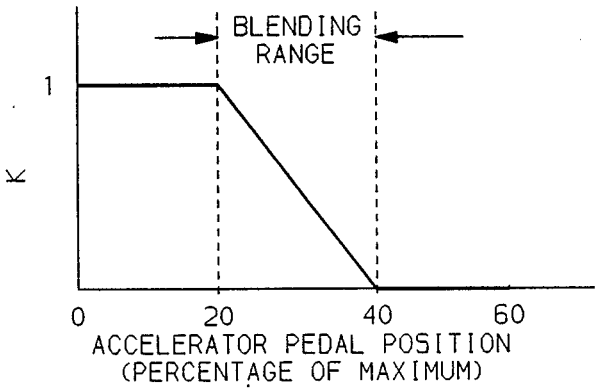
FIG. 4 is a graphical representation showing the behavior of a blending variable K, used for determining the fuel per cylinder delivered to the engine, as a function of accelerator pedal position.

The PED signal is also used by computer 48 in computing the amount of fuel per cylinder to supply to engine 10. At a given engine speed, the total fuel per cylinder delivered to the engine is based upon both the an indication of the mass air per cylinder actually delivered to engine 10 and the indicated engine output power demanded by the operator. The fuel per cylinder is computed according to the relationship $$\text{ti FUEL/CYLINDER} = K*FCOD + (1-K)*FCMA, \quad (1)$$

where, FCOD is the fuel per cylinder based upon operator demand for output power, as indicated by PED; FCMA is the fuel per cylinder based upon the actual air mass per cylinder delivered to the engine, as derived from MAF; and K is a blending variable which is a function of engine speed and the accelerator pedal position as indicated by PED. For engine speeds near idle (800–1000 RPM), FIG. 4 illustrates a graph of the variable K as a function of the percentage of maximum accelerator pedal position. For operator demand up to 20 percent of full engine output power (or 20 percent movement of the accelerator pedal), the variable K equals one, and the delivered FUEL/CYLINDER = FCOD, according to equation (1). For operator demand above 60 percent of full engine output power, K equals zero and the delivered FUEL/CYLINDER = FCMA. In the blending range from 20 to 40 percent of full accelerator pedal movement, K decreases linearly from a value of one to zero, with the FUEL/CYLINDER varying according to equation (1). Thus, K acts as a blending variable to assure a continuous delivery of fuel and smooth engine operation, as engine operation moves to the region where the delivered mass air per cylinder increases rather than decreases with increasing operator demand for output power.

Figure 5:
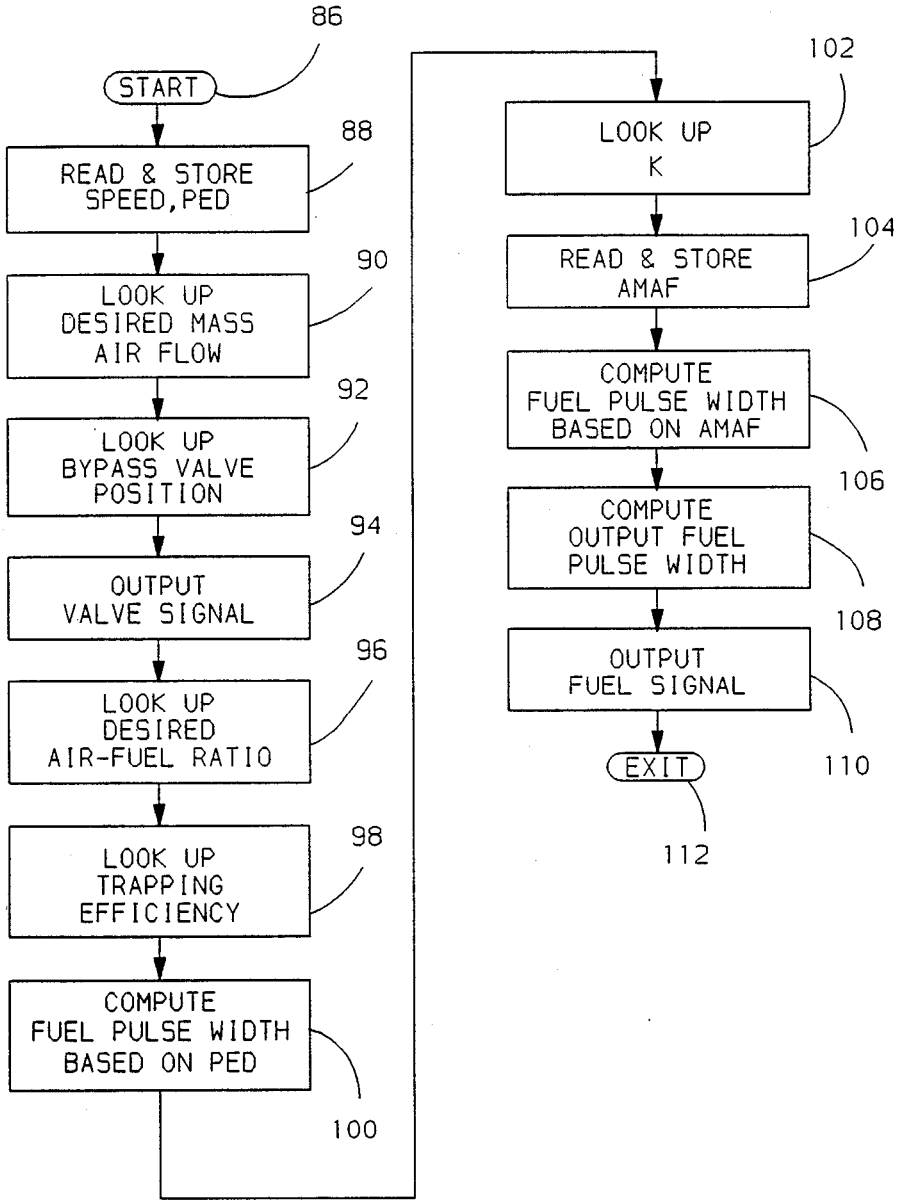
FIG. 5 is a flow diagram illustrating the operation of the computer of FIG. 1 in controlling an engine in accordance with the principles of this invention.

Referring now to FIG. 5, there is shown a flow diagram illustrating the operation of computer 48 in controlling engine 10 according to the principles of the present invention. The programming of computer 48 to implement the illustrated steps should be clear to any programmer skilled in the art of engine control.

After engine start up, the routine begins at step 86 and is executed by computer 48 at regular intervals of approximately 6 milliseconds. At step 88 computer 48 determines and stores values the current engine operating speed in RPM and the accelerator pedal position PED.

At step 90, the program looks up the desired mass air flow DMAF for minimum hydrocarbons from a table stored in memory using values for engine speed and PED stored in the previous step. The values for desired mass air flow are obtained from measured engine speed-load curves such as presented in FIG. 2. For speeds near engine idle and light operator induced loading, the desired air flow will be less than that flowing at unloaded engine idle for minimum hydrocarbons as described previously.

Next at step 92, the position for bypass valve 78 is looked up in a table stored in memory as a function of the desired air flow found in the previous step 90.

At step 94, the program outputs a value of VALVE SIGNAL, which corresponds to the bypass valve position determined at step 92. Thus, the air flow to the engine is adjusted to the value scheduled to minimize hydrocarbons in the exhaust gas of engine 10.

Next at step 96, the program looks up the desired air-fuel ratio (A/F) in a table stored in computer memory, using values for the accelerator pedal position PED and the speed of the engine. Values in the air-fuel ratio table are determined by standard engine dynamometer measurements at different speeds, and different engine loading corresponding to that desired by operator movement of the accelerator pedal.

At step 98, the program looks up a value for trapping efficiency (TE) in another table stored in memory, using values for the engine speed, and the desired mass air flow found previously in step 90. The trapping efficiency represents that percentage of the mass air inducted into crankcase chamber 18, which is transferred and captured within combustion chamber 38, after closure of air inlet port 32 and exhaust port 26. Values for trapping efficiency are determined by measurement, and are a function of the mass of air being transferred from the crankcase chamber 18, and the engine speed which determines the time available for the air to pass through inlet port 32 or be lost out exhaust port 24.

At step 100, the injector fuel pulse width (FPWOD) based upon accelerator pedal position PED (or equivalently operator demand for engine output power) is computed according to the following:

$$FPWOD = C*(DMAF)*TE*[1/(A/F)], \quad (2)$$

where C is a predetermined units scaling constant stored in memory, DMAF is the desired mass air flow determined at step 90, TE is the trapping efficiency determined at step 98, and A/F is the air-fuel ratio based upon accelerator pedal position found in step 96.

Next at step 102, the value for the blending variable K is looked up in a table stored in memory, using values for the accelerator pedal position PED and the engine speed. For values of engine speed near idle, in the range from 800 to 1000 RPM, the value of K varies with accelerator pedal position PED, as shown previously in FIG. 4.

At step 104, the actual mass air per cylinder (AMAF) flowing into the engine 10 is derived from the MAF input signal and stored in memory. This value for AMAF is then used in the next program step 106 to compute FPWMAF, the injector fuel pulse width based upon the actual mass air per cylinder, according to the following:

$$FPWMAF = C*AMAF*TE*[1/(A/F)]. \quad (3)$$

Next at step 108, the final output fuel pulse width FPW is computed as a function of both FPWOD and FPWMAF, determined at steps 100 and 106, respectively, according to $$FPW = K*FPWOD + (1-K)*FPWMAK. \quad (4)$$

At step 110, the program outputs FUEL SIGNAL to fuel injector 36, consisting of a pulse having a width equal to FPW as computed in step 108. With this output pulse enabling injector 36, the delivered fuel per cylinder will be that given previously in equation (1), as can be easily shown by multiplying both sides of equation (4) by the fuel delivery rate of injector 36.

Finally at step 112, the routine is exited, so that other engine control functions may be performed by computer 44.

Another embodiment of the present invention is possible using the lost motion throttle linkage, without bypass passage 76 and the solenoid activated bypass valve 78 being present in intake manifold 20. In this embodiment, the delivered air per cylinder, during the lost motion interval of the throttle linkage, will remain constant rather than decreasing according to minimum hydrocarbon schedule. By maintaining the delivered air per cylinder constant, rather than reducing it over the lost motion interval, the reduction in exhaust gas hydrocarbons will be less, but the emission control system is simplified without the bypass valve and associated positioning control.

The aforementioned description of a preferred embodiment of the invention is for the purpose of illustrating the invention, and is not to be considered as limiting or restricting the invention, since many modifications may be made by the exercise of skill in the art without departing from the scope of the invention.

The embodiments of the invention in which an exclusive property or privilege is claimed are defined as follows:

1. A control system for reducing hydrocarbon emissions in the exhaust gas of a crankcase scavenged, two-stroke engine, the control system comprising:

means for increasing the fuel per cylinder delivered to the engine, as operator demand for engine output power increases;

means for restricting the delivered mass of air per cylinder to a value less than or equal to that delivered at unloaded engine idle, as engine output power is increased over a defined range of engine operation near idle.

2. The control system of claim 1 in which the means for increasing the fuel per cylinder supplied to the engine includes:

means for deriving an indication of engine operating speed;

means for deriving an indication of operator demand for engine output power;

means for deriving an indication of the mass of air per cylinder flowing to the engine;

means for increasing the fuel per cylinder delivered to the engine in accordance with the expression $$\text{FUEL/CYLINDER} = K*FCOD + (1-K)*FCMA$$

where

FCOD is the fuel per cylinder based upon operator demand for engine output power and engine speed, FCMA is the fuel per cylinder based upon the mass of air per cylinder flowing into the engine and engine speed; and K is a blending variable depending upon engine speed, but having a value of 1 for unloaded engine operation within a specified range of engine speeds near idle, and decreasing in value to 0 as operator demand for engine output moves engine operation outside the predefined range.

3. The control system of claim 1 in which the delivered air mass per cylinder is maintained at a constant value, equal to that delivered at unloaded engine idle, as the demand for engine output power increases over the defined range of engine operation.

4. The control system of claim 3 in which the means for maintaining constant air mass per cylinder over the defined range of engine operation comprises:

an engine air intake manifold having a throttle valve therein;

an operator actuated control element; and a linkage means connecting the control element to the throttle valve, and providing a lost motion interval corresponding to the defined range of engine operation, where initial operator movement of the control element does not affect the throttle valve opening, but further movement of the control element outside the interval of lost motion influences throttle valve opening.

5. The control system of claim 1 in which the delivered air mass per cylinder is reduced from that value delivered at unloaded engine idle, according to a predetermined schedule, as the demand for engine output power increases over the defined range of engine operation.

6. The control system of claim 5 in which the means for reducing the air mass per cylinder according to a predefined schedule over the defined range of engine operation comprises:

an engine air intake manifold having a throttle valve therein, and an air passage bypassing the throttle valve with a bypass control valve disposed therein;

an operator actuated control element;

a linkage means connecting the control element to the throttle valve which provides a lost motion interval corresponding to the defined range of engine operation, where initial operator movement of the control element, within the interval of lost motion, does not affect the throttle valve opening, but further movement, outside the interval, influences throttle valve opening; and means for adjusting the bypass valve to restrict air flow to the engine in accordance with the predetermined schedule.

* * * * *

UNITED STATES PATENT AND TRADEMARK OFFICE

CERTIFICATE OF CORRECTION

PATENT NO. : 4,932,371

DATED : June 12, 1990

INVENTOR(S) : William C. Albertson et al

It is certified that error appears in the above-identified patent and that said Letters Patent is hereby corrected as shown below:

Column 7, line 22, delete "ti FUEL/CYLINDER = K*FCOD + (1-K)*FCMA(,1)" and insert therefore
-- FUEL/CYLINDER = K*FCOD + (1-K)*FCMA, (1) --, In claim 1 of the patent at column 9, line 34, delete the word "crankcase".

Signed and Sealed this

Twenty-third Day of November, 1993

*Attest:*

Bruce Lehman

BRUCE LEHMAN

*Attesting Officer*

*Commissioner of Patents and Trademarks*